US011635202B2

(12) United States Patent
Juranitch et al.

(10) Patent No.: US 11,635,202 B2
(45) Date of Patent: Apr. 25, 2023

(54) DIRTY WATER AND EXHAUST CONSTITUENT FREE, DIRECT STEAM GENERATION, CONVAPORATOR SYSTEM, APPARATUS AND METHOD

(71) Applicant: XDI Holdings, LLC, Bedford, NH (US)

(72) Inventors: James C. Juranitch, Ft. Lauderdale, FL (US); Raymond Clifford Skinner, Coral Springs, FL (US); Alan Craig Reynolds, Novi, MI (US)

(73) Assignee: XDI Holdings, LLC, Bedford, NH (US)

( * ) Notice: Subject to any disclaimer, the term of this patent is extended or adjusted under 35 U.S.C. 154(b) by 253 days.

(21) Appl. No.: 16/077,975

(22) PCT Filed: Feb. 28, 2017

(86) PCT No.: PCT/US2017/019978
§ 371 (c)(1),
(2) Date: Aug. 14, 2018

(87) PCT Pub. No.: WO2017/151635
PCT Pub. Date: Sep. 8, 2017

(65) Prior Publication Data

US 2021/0190309 A1 Jun. 24, 2021

Related U.S. Application Data

(60) Provisional application No. 62/301,521, filed on Feb. 29, 2016.

(51) Int. Cl.
*F22B 1/12* (2006.01)
*E21B 43/16* (2006.01)
(Continued)

(52) U.S. Cl.
CPC ..... *F22B 1/126* (2013.01); *E21B 43/164* (2013.01); *E21B 43/2406* (2013.01);
(Continued)

(58) Field of Classification Search
CPC ..... F23G 7/008; F22G 1/005; F22D 11/006; F22D 1/003; F22D 1/26; F22D 1/22;
(Continued)

(56) References Cited

U.S. PATENT DOCUMENTS 4,330,038 A * 5/1982 Soukup ..... E21B 43/40 166/267
4,398,604 A 8/1983 Krajicek et al.
(Continued)

FOREIGN PATENT DOCUMENTS

KR 2011019174 A * 2/2011

OTHER PUBLICATIONS

KR-2011019174-A Translation (Year: 2011).*

*Primary Examiner* — Steven B McAllister
*Assistant Examiner* — Benjamin W Johnson
(74) *Attorney, Agent, or Firm* — Dykema Gossett PLLC

(57) ABSTRACT

Embodiments of the present disclosure include a system, method, and apparatus comprising a direct steam generator configured to generate saturated steam and combustion exhaust constituents.

17 Claims, 3 Drawing Sheets

(51) Int. Cl.

| | |
|---|---|
| ***E21B 43/24*** | (2006.01) |
| ***F22B 1/16*** | (2006.01) |
| ***F22B 1/18*** | (2006.01) |
| ***F22B 1/22*** | (2006.01) |
| ***F22D 1/00*** | (2006.01) |
| ***F22D 11/00*** | (2006.01) |
| ***F22G 1/00*** | (2006.01) |
| *F23G 7/00* | (2006.01) |

(52) U.S. Cl.
CPC ..... *F22B 1/165* (2013.01); *F22B 1/18* (2013.01); *F22B 1/22* (2013.01); *F22D 1/003* (2013.01); *F22D 11/006* (2013.01); *F22G 1/005* (2013.01); *F23G 7/008* (2013.01)

(58) Field of Classification Search
CPC . F22D 1/18; F22D 1/165; F22D 1/126; E21B 43/2406; E21B 43/164
USPC ..... 122/5
See application file for complete search history.

(56) References Cited

U.S. PATENT DOCUMENTS

| | | | | |
|---|---|---|---|---|
| 4,498,542 | A | 2/1985 | Eisenhawer et al. | |
| 4,565,249 | A | 1/1986 | Pebdani et al. | |
| 5,020,595 | A | 6/1991 | Van Slyke | |
| 7,931,083 | B2 | 4/2011 | Betzer Tsilevich | |
| 2003/0155111 | A1* | 8/2003 | Vinegar | E21B 43/243 166/59 |
| 2010/0132360 | A1 | 6/2010 | Gericke | |
| 2011/0185712 | A1* | 8/2011 | Burns | F28F 1/325 60/320 |
| 2014/0130498 | A1* | 5/2014 | Randolph | E21B 43/24 60/645 |
| 2014/0137779 | A1* | 5/2014 | Pronske | F22B 1/18 110/345 |
| 2015/0369025 | A1 | 12/2015 | Latimer et al. | |
| 2016/0348895 | A1 | 12/2016 | Juranitch | |

* cited by examiner

DIRTY WATER AND EXHAUST CONSTITUENT FREE, DIRECT STEAM GENERATION, CONVAPORATOR SYSTEM, APPARATUS AND METHOD

CROSS-REFERENCE TO RELATED APPLICATION

This application is the national stage application of International application no. PCT/US17/19978, filed 28 Feb. 2017 (the '978 application) and published under International publication no. WO 2017/151635 A1 on 8 Sep. 2017. This application claims priority to U.S. provisional patent application No. 62/301,521 entitled "DIRTY WATER AND EXHAUST CONSTITUENT FREE, DIRECT STEAM GENERATION, CONVAPORATOR SYSTEM, APPARATUS AND METHOD", filed 29 Feb. 2016 the '521 application). The '978 application and the '521 application are both hereby incorporated by reference as though fully set forth herein.

FIELD OF THE INVENTION

Embodiments of the present disclosure relate generally to a method, apparatus and system for the generation of steam from dirty water, salty water and produced water.

DESCRIPTION OF THE RELATED ART

Direct Steam Generators (DSG) are not well accepted in steam assist gravity drain (SAGD), Steam Flood and Cyclic Steam Stimulation (CSS) heavy oil recovery. This is due to the fact that the steam is diluted with exhaust gas from the combustion process in a DSG. Many in the oil industry feel that exhaust gas, primarily made up of CO2 and N2, has negative effects in heavy oil production in most wells. This thought process has evolved from the opposite view as noted in U.S. Pat. No. 4,565,249 "Heavy Oil Recovery Process Using Cyclic Carbon Dioxide Steam Stimulation" and U.S. Pat. No. 5,020,595 "Carbon Dioxide-Steam Co-Injection Tertiary Oil Recovery Process" where CO2 was thought to be a benefit when injected in a heavy oil recovery process. The current belief is that no exhaust constituents are the preferred composition of production steam in most of the wells executing heavy oil recovery processes such as SAGD. Dealing with the inevitable solids in all types of steam production has always been problematic. The heavy oil industry today uses 2 to 4 barrels of water (turned into steam) for every barrel of oil it produces. The oil and gas industry currently utilizes extensive water treatment technologies at the well site to clean its process water before making steam, typically in the more accepted Once Through Steam Generators (OTSG). OTSGs do not have exhaust gas constituents in the steam they produce, which is one of the primary reasons they are favored. Unfortunately, they do require high quality water to operate on. It is a common comment that modern SAGD sites, due to OTSGs, are really large and expensive water treatment plants attached to a small well pad. The water treatment plant and process currently used in conventional OTSG requires extensive labor and large amounts of expendable chemicals and energy to operate. During normal operations, these water treatment plants produce a significant waste stream of lime sludge and other byproducts that must be disposed of. Due to the operational expense and capital required to build ever more complete water treatment plants, the norm in the oil industry is to limit the steam quality from 70 to 80% in the OTSG.

In other words 20 to 30% of the liquid input or feed water stays in a liquid state and is not converted to steam. This practice helps to limit the deposits that will build up inside the OTSG, which will eventually disable its operation. To produce a higher quality steam in an OTSG, the water would first have to be treated to a higher purity level, thus adding additional expense and complexity to an already too large and too complex water treatment system. Unfortunately, the practice of low quality OTSG steam production is energy and resource inefficient since the spent process water, or blow down, wastes most of its energy and water resources without recovering any oil product. This practice produces excessive greenhouse gasses (GHG) from the wasted energy and an additional waste stream from the OTSG, which is the blow down fluid. The amount of blow down produced is significant. Only about ⅓ of the blow down water is recovered in most systems. The balance of the blow down waste water contains many contaminated solid compounds that include Magnesium, Calcium and Silicon. This blow down must be disposed of in deep wells or again run through very expensive and complex processes to reclaim the valuable water content.

The DSG boilers do not, in many cases, suffer from most of the above problems. The current technology DSG boilers need relatively clean feedwater but not to the level required by OTSG. The DSG boilers typically have limited or no blow down. Their biggest problem is that their steam is contaminated by the exhaust constituents they produce through combustion.

DSG boilers are typically more efficient than OTSG boilers. This is due to the elimination of the tube heat exchanger used in a OTSG boiler. In comparison, in a DSG boiler, the oxidized fuel transfers its energy directly to the process steam with no intermediate tube. This higher efficiency is a desirable trait. U.S. Pat. Nos. 7,931,083, 4,498,542 and 4,398,604 all discuss the positive traits of DSG, but offer no solution to removing the bad traits associated with the exhaust constituents such as CO2 and N2 from the steam product. As noted, this makes the existing DSG technology unacceptable and a non-starter for modern heavy oil recovery. A method, apparatus and system of eliminating the bad traits associated with the DSG's exhaust constituents is required to allow their acceptance in the oil recovery sector and other industries.

One such solution is presented in US patent application no. 2015/0369025. Here, a DSG generates steam and CO2, which is cooled, then separated at very high pressure, then expanded by an expansion valve, then reheated with additional heat from a conventional heat exchanger. This vaporization cycle in US patent application no. 2015/0369025 is near identical to the well-known conventional air conditioning DX cycle where a compressed fluid is flashed back into a gas across a pressure reducing valve aided by an additional heat exchanger. Embodiments disclosed in US patent application no. 2015/0369025 are associated with undesirable side effects that include, for example, significant energy being lost in the release of the CO2 byproduct from the expansion tank at high pressure. In US patent application no. 2015/0369025, approximately all the energy improvements discussed related to a DSG's higher efficiency when compared to a conventional drum or Once Through Steam Generator are lost in the release of the high pressure CO2 from the high pressure separation tank. High pressure separation tanks are difficult and expensive to fabricate. The significant surface area associated with a separation tank at high pressure is a safety and design liability. The CO2 that is released at the high pressure expansion tank will, due to its high vapor pressure state, release or waste significant amounts of water, again defeating the purpose of using a more advanced steam generator, such as a DSG. None of these conditions are desirable. A need for a more efficient and safer DSG steam generation system with exhaust constituent separation is needed and disclosed herein.

SUMMARY

Embodiments of the present disclosure can include a system for generating steam. The system can comprise a direct steam generator configured to generate saturated steam and combustion exhaust constituents from feedwater. A close coupled heat exchanger can be fluidly coupled to the direct steam generator. The close coupled heat exchanger can be configured to route the saturated steam and combustion exhaust constituents through a condenser portion of the close coupled heat exchanger via a condenser side steam conduit and configured to condense the saturated steam to form a condensate. A pressure reducing device can be fluidly coupled with a condenser side condensate conduit of the close coupled heat exchanger condenser. A separation tank and water return system can be fluidly coupled to the pressure reducing device via an expansion conduit. The separation tank and water return system can be configured to separate the combustion exhaust constituents from the condensate. An evaporator portion of the close coupled heat exchanger can be fluidly coupled with the separation tank and water return system via an evaporator side condensate conduit. The evaporator portion can be configured to evaporate the condensate from the separation tank and water return system via heat transfer between the condenser portion and evaporator portion of the close coupled heat exchanger to form steam.

Embodiments of the present disclosure can include a system for generating steam. The system can include a direct steam generator. A feed conduit can be fluidly coupled to the direct steam generator and can be configured for delivery of feedwater to the direct steam generator, wherein the feedwater includes organic and inorganic constituents. A fuel source can be fluidly coupled to the direct steam generator to provide power to operate the direct steam generator. At least one of an air conduit and an oxygen enriched air conduit can be fluidly coupled with the direct steam generator. A close coupled heat exchanger can be fluidly coupled to the direct steam generator. The close coupled heat exchanger can be configured to route saturated steam and combustion exhaust constituents produced by the direct steam generator through a condenser portion of the close coupled heat exchanger via a condenser side steam conduit and configured to condense the saturated steam to form a condensate. A pressure reducing device can be disposed after the close coupled heat exchanger condenser and fluidly coupled to the condenser portion of the close coupled heat exchanger via a condenser side condensate conduit. A low pressure separation tank and water return system can be fluidly coupled to the pressure reducing device via an expansion conduit. The separation tank and water return system can be configured to separate the combustion exhaust constituents from the condensate. An evaporator portion of the close coupled heat exchanger can be fluidly coupled with the separation tank and water return system via an evaporator side condensate conduit. The evaporator portion can be configured to evaporate the condensate from the separation tank and water return system via heat transfer between the condenser portion and evaporator portion to form steam.

Embodiments of the present disclosure can include a system for generating steam. The system can include a direct steam generator configured to generate saturated steam and combustion exhaust constituents from feedwater. An advanced high heat transfer close coupled heat exchanger can be fluidly coupled to the direct steam generator. The close coupled heat exchanger can be configured to route the saturated steam and combustion exhaust constituents through a condenser portion of the close coupled heat exchanger via a condenser side steam conduit and configured to condense the saturated steam to form a condensate. A pressure reducing device can be located downstream of the close coupled heat exchanger condenser and fluidly coupled with a condenser side condensate conduit of the close coupled heat exchanger. A low pressure separation tank and water return system can be fluidly coupled to the pressure reducing device via an expansion conduit. The low pressure separation tank and water return system can be configured to separate the combustion exhaust constituents from the condensate. An evaporator portion of the advanced high heat transfer close coupled heat exchanger can be fluidly coupled with the separation tank and water return system via an evaporator side condensate conduit. The evaporator portion is configured to evaporate the condensate from the separation tank and water return system via heat transfer between the condenser portion and evaporator portion of the advanced high heat transfer close coupled heat exchanger to form steam.

DETAILED DESCRIPTION

Figure 1:
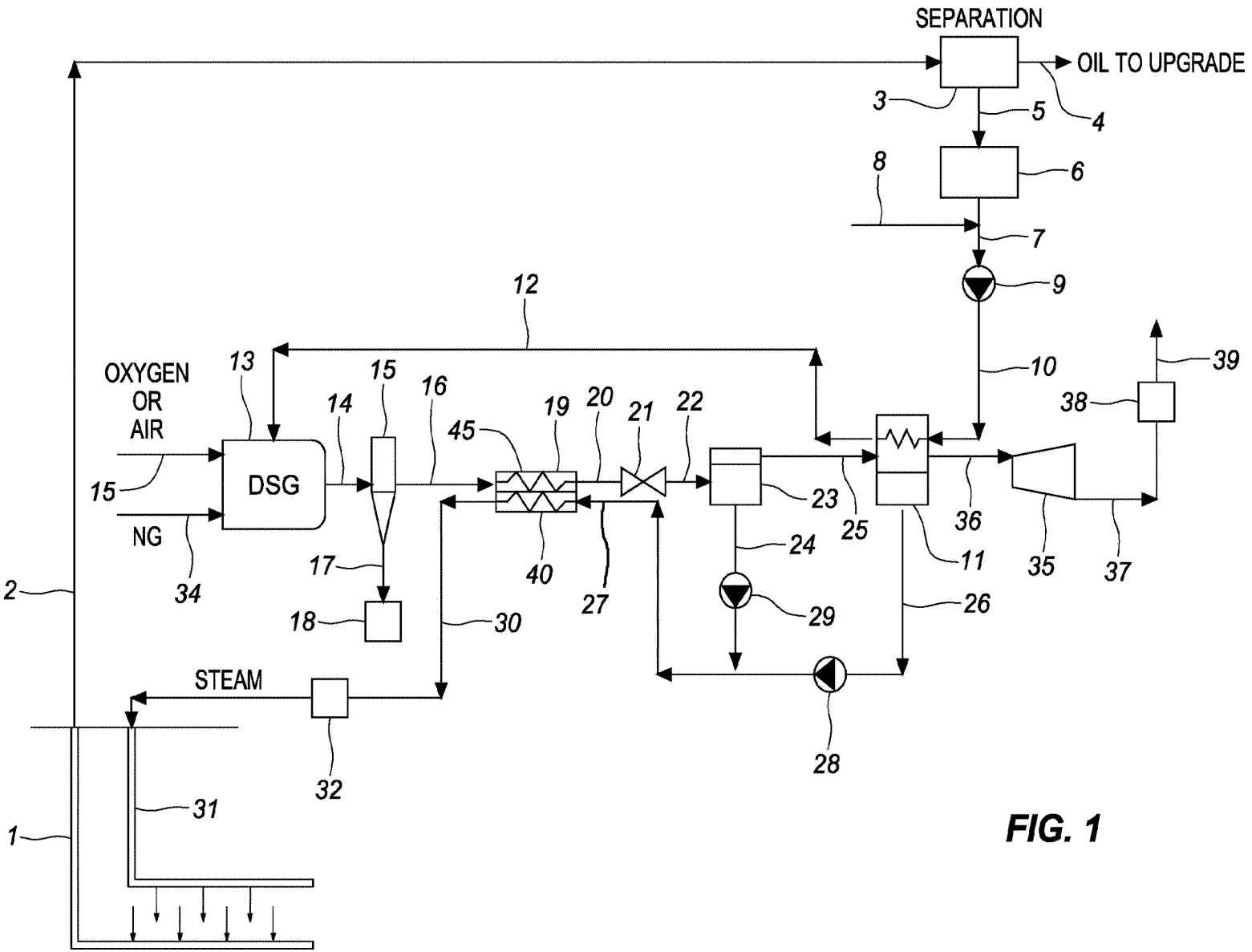
FIG. 1 depicts a simplified schematic representation of a dirty water, direct steam generation and convaporator system, in accordance with embodiments of the present disclosure.

Embodiments of the present disclosure can include a system, method, and apparatus comprising a direct steam generator configured to generate saturated or super-heated steam and combustion exhaust constituents. The system, apparatus and method, in a preferred embodiment, can include a Direct Steam Generation (DSG) unit. A preferred embodiment can include a Zero Liquid Discharge (ZLD), a Zero Waste and a Zero Greenhouse Gas generation system, apparatus and method. Embodiments of the present disclosure can produce a steam product, which can be used in any steam application, but is particularly well suited for Steam Assist Gravity Drain (SAGD) heavy oil applications. CO2 and exhaust constituents can be separated from the steam product and, in some embodiments, sequestered.

Embodiments of the present disclosure can include a thermodynamic cycle, which exploits an efficient and unconventional heat transfer system which does not require a pressure drop or expansion to flash the steam as found in a conventional air conditioning or DX cycle. As part of this cycle, a unique highly efficient close coupled heat exchanger can be fluidly coupled to the direct steam generator. The efficient close coupled heat exchanger (also referred to herein as "convaporator," since it efficiently provides condensing to one stream while evaporating the other) allows this thermodynamic cycle to be cost effective and of a performance and form factor that fits the intended market. The cycle is configured to route the saturated steam and combustion exhaust constituents through an expansion valve, where the pressure is reduced, before a low pressure expansion tank and a low pressure condensing-separator. This thermodynamic cycle exercises its pressure drop opposite to conventional and existing cycles. The condensed liquids from the low pressure separation tank (e.g., expansion tank) and low pressure condensed liquids from the low pressure condensing-separator (e.g., separation tank), which can act as a downstream condenser and separator, are combined and flowed through the convaporator, which re-vaporizes the condensed liquids to produce steam. Within the low pressure condensing-separator, low pressure CO2 gas with minimized water carry over due to the CO2 gas's lower vapor pressure is largely separated from the liquid water at the lower pressure, thus reducing the amount of CO2 remaining dissolved in the water.

The low pressure separation tank is downstream from an expansion valve that effects a pressure drop in the thermodynamic cycle, which allows for a safer and more cost effective low pressure design.

The low pressure condensing-separator can use the DSG feedwater as a cooling source, thus capturing the energy to reduce the fuel and oxidizer usage in the DSG for improved energy efficiency. Further energy efficiency can be gained through an optional CO2 expansion process, which can include a power recovery device, such as a turbo expander coupled to a generator or other advantageous mechanical device, such as a pump or compressor.

This present disclosure realizes important reductions in the structural requirements of the separation system by reducing the pressure in the separation vessels and interconnecting conduits. The reduction of the structural requirements improves safety and reduces the weight and costs of the overall system.

Embodiments of the present disclosure can separate the generated process steam produced by a DSG from its exhaust combustion constituents. When oxygen and/or highly oxygen enriched air is used for combustion, the method and system can gain efficiency and isolate the exhaust constituents primarily made up of CO2 to minimize the generation of green house gas (GHG). Due to the lack of N2, when highly oxygen enriched air is used for combustion, the NOx production is also minimized or eliminated without the use of after treatments. The DSG can also operate on produced water, sewage, bitumen production pond water, and/or extremely dirty and/or salty water. Embodiments of the present disclosure can eliminate all waste streams including blow down and can be a Zero Liquid Discharge, a Zero Green House Gas and a Zero Waste system, apparatus and method. The method, apparatus and system of the present disclosure, can use any fossil fuel, or other fuel source to accomplish its goals, in various embodiments.

Referring first to FIG. 1, production wellbore 1 serves as a conduit for produced water and bitumen product associated with a SAGD heavy oil operation. For example, the produced water and bitumen product can flow from a subterranean formation through the production wellbore 1 to the surface. The example used for clarity in this document is a SAGD heavy oil application; however, embodiments of the present disclosure are not limited to only SAGD applications. For example, embodiments of the present disclosure can be used in any application that requires steam generation.

Production conduit 2 can be operatively connected to the oil separation system 3 and can carry the produced water and bitumen to oil separation system 3. Oil separation system 3 can be implemented many different ways at many different well sites, but can typically include a Free Water Knock Out (FWKO) and other heavy oil separation systems known to those skilled in the art. Crude oil conduit 4 can be operatively connected to the oil separation system 3 and can carry an end product of a SAGD operation. For example, the crude oil conduit 4 can carry an acceptable crude oil product that then can be delivered for further processing to a refinery. Diluent additive, centrifuges and other bitumen upgrade processes have not been discussed, however can additionally be included in embodiments of the present disclosure.

Separated water conduit 5 can be operatively connected to the oil separation system 3 and a feed water filtration system 6. The separated water conduit 5, can carry water, also known as "Produced Water," which has been separated from the crude oil product, to the feed water filtration system 6, which can filter the separated water 5 and output filtered water. The filtered water can travel through a filtered water conduit 7, and can optionally be augmented by makeup water 8 which could be dirty water, salty water, sewage, and/or bitumen production pond water, which in some embodiments can be filtered, to create a feed stock. The feed stock (optionally augmented with the makeup water) can be pressurized in pump 9 then flowed via feedwater conduit 10 to condensing-separator tank 11, where it can be heated and then fed to the DSG 13 via DSG feed conduit 12.

Within the DSG 13, the feed from DSG feed conduit 12 can be added to a continuously combusted mixture of fuel, such as Natural Gas (NG), provided to the DSG 13 via NG conduit 34. In a preferred embodiment, only highly oxygen enriched air is used for combustion in a near stoichiometric relationship and can be injected into the DSG 13 via oxygen enriched air conduit 15. The fossil fuels injected and/or organic product included in the feed stock fed to the DSG 13 can be oxidized in the DSG 13 and can be converted to primarily water and steam, which helps the overall process, while substantially generating pure CO2 and steam at condensing-separator exhaust conduit 36. The CO2 could be re-injected in aging SAGD wells or other storage systems to minimize GHG production.

The output from the DSG 13 can be introduced to the input of the steam-particulate separator 15 via separator feed conduit 14. Within the steam-particulate separator 15, the now combusted and largely vaporized input can be separated into a stream that consists largely of steam and CO2 passing out through saturated steam conduit 16 and/or into a wet or dry particulate, depending if super-heat is utilized via separator particulate conduit 17 to a product reclamation process 18 or other waste processing systems.

Figure 2:
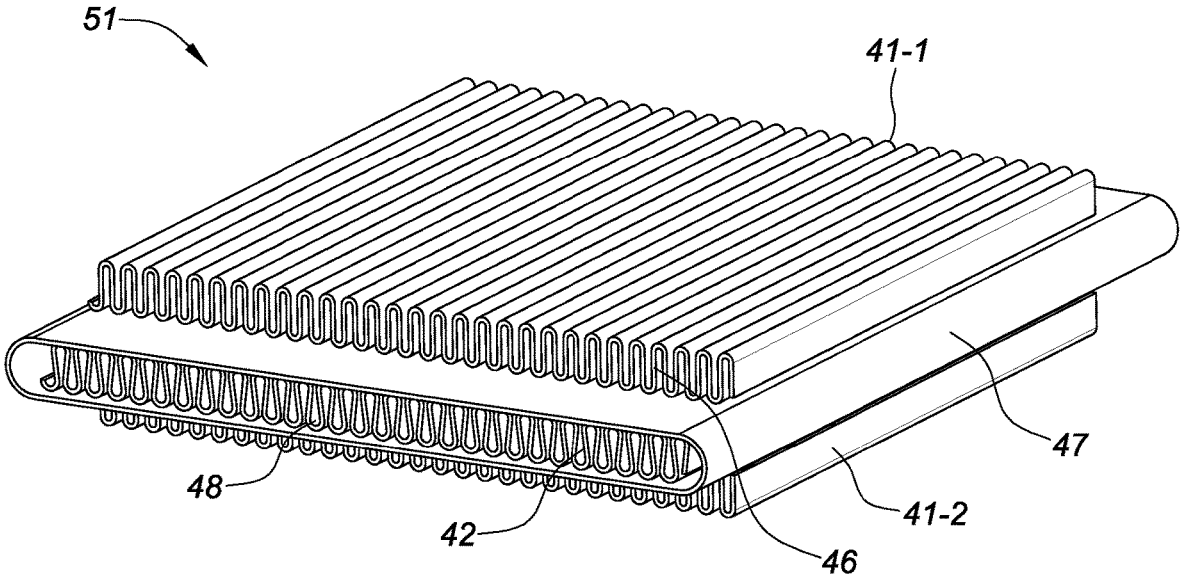
FIG. 2 depicts a close coupled high heat transfer exchanger element, in accordance with embodiments of the present disclosure.
Figure 3:
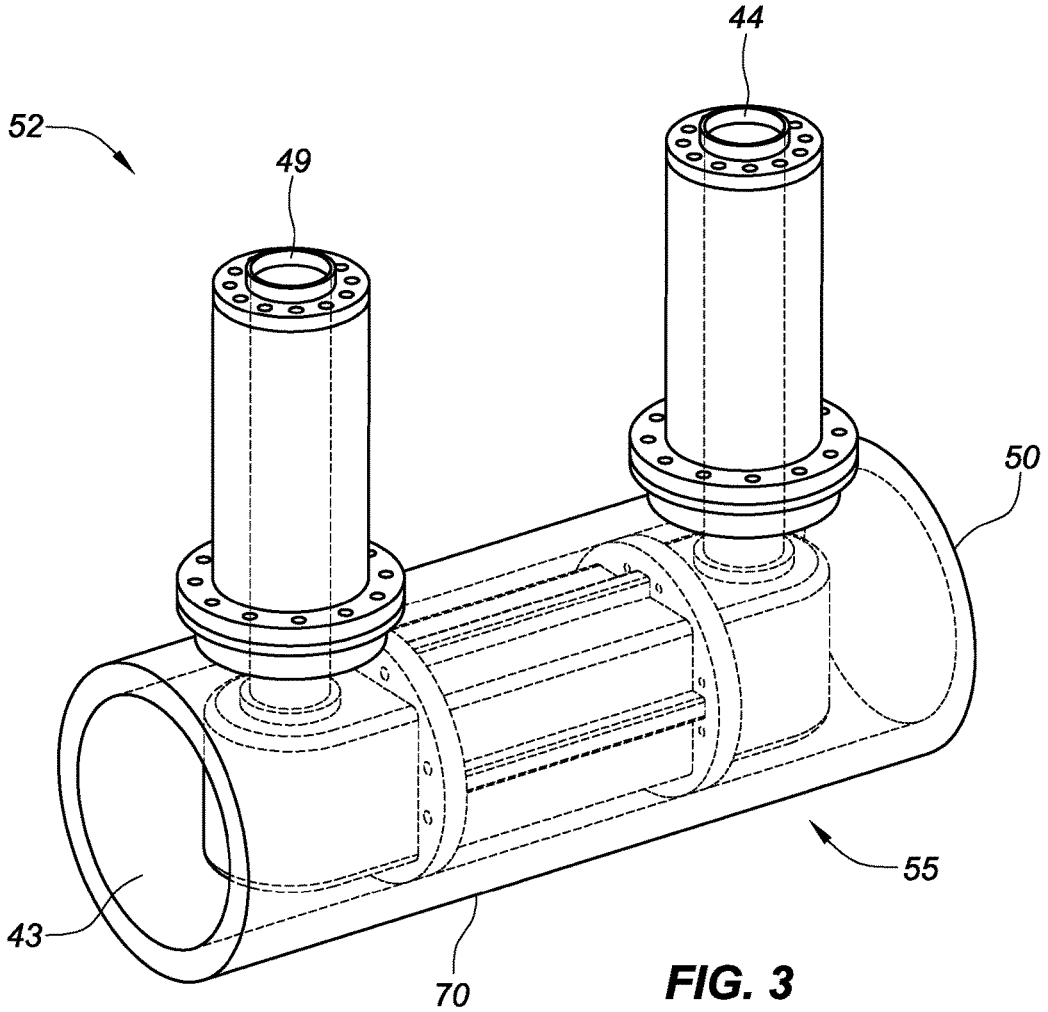
FIG. 3 depicts a convaporator assembly that employs the close coupled high heat transfer exchange element depicted in FIG. 2, in accordance with embodiments of the present disclosure.

If a blended steam and exhaust constituent product is desired, it can be harvested at saturated steam conduit 16. If a steam product is desired that is void of exhaust constituents, then it can be further processed through the convaporator 19. A design of a convaporator heat exchange core 51 and associated housing 52 is shown in FIGS. 2 and 3. In some embodiments, the convaporator heat exchange core 51 can be constructed from a corrugated metal design, as depicted in FIG. 2. For example, a first corrugated heat exchange element 42 can be constructed from a planar sheet of corrugated material (e.g., metal) and a first fluid can be passed through lumens 48 formed by the first corrugated heat exchange element 42. The sheet of corrugated material can be surrounded by an enclosure 47, which can be configured to separate the first fluid passing through lumens 48 formed in the first corrugated heat exchange element 42, as depicted in FIG. 2, from fluid flowing through lumens 46 formed in an adjacent heat exchange element (e.g., heat exchange elements 41-1, 41-2). In an example, a second corrugated heat exchange element 41-1 can be disposed on an opposite side of the enclosure 47 from the first corrugated heat exchange element 42 and a second fluid can be passed through lumens 46 formed in second corrugated heat exchange element 41-1. In some embodiments, heat can be transferred between the first corrugated heat exchange element 42 and the second corrugated heat exchange element 41-1 (e.g., across enclosure 47). In some embodiments, the first fluid can be at a temperature that is greater than the second fluid. However, in some embodiments, the second fluid can be at a temperature that is greater than the first fluid. In some embodiments, multiple corrugated heat exchange elements can be stacked on top of/next to one another and separated via enclosures (e.g., enclosure 47). For example, as depicted, a hot fluid (e.g., steam) can be passed through second corrugated heat exchange element 41-1 and third corrugated heat exchange element 41-2 and a cold fluid (e.g., condensate) can be passed through the first corrugated heat exchange element 42. Although three corrugated heat exchanger elements are depicted in FIG. 2, additional heat exchanger elements (e.g., corrugated heat exchange elements) can be included and stacked on top of/next to one another.

In some embodiments, the convaporator heat exchange core 51 depicted in FIG. 2 can maximize surface contact to both working fluids (e.g., hot and cold fluid) that pass through a first fluid inlet 43 and second fluid inlet 44 of a convaporator housing 52 that houses a convaporator heat exchanger 55, depicted in FIG. 3, to consequently maximize heat and energy transfer as opposed to a lower performance conventional tube and shell or plate style heat exchanger. In some embodiments, a first fluid can flow through first fluid inlet 43, through one or more of the heat exchange elements depicted in FIG. 2 (e.g., second corrugated heat exchange element 41-1 and third corrugated heat exchange element 41-2), and out first fluid outlet 50; and a second fluid can flow through second fluid inlet 44, through another one or more of the heat exchange elements depicted in FIG. 2 (e.g., first corrugated heat exchange element 42) and out second fluid outlet 49. For example, the second and third corrugated heat exchanger elements 41-1,42-2 can be in fluid communication with the first fluid inlet 43 and first fluid outlet 50 and the first corrugated heat exchanger element 42 can be in fluid communication with the second fluid inlet 44 and the second fluid outlet 49. As the first and second fluid flow through their respective heat exchange elements, heat can be transferred from one fluid to the other. In some embodiments, the second and third corrugated heat exchanger elements 41-1, 42-2 can be in fluid communication with the second fluid inlet 44 and second fluid outlet 49 and the first corrugated heat exchanger element 42 can be in fluid communication with the first fluid inlet 43 and the first fluid outlet 50. As the first and second fluid flow through their respective heat exchange elements, heat can be transferred from one fluid to the other. In some embodiments, as a first fluid flows into the first fluid inlet 43 and out the first fluid outlet 50 and the second fluid flows into the second fluid inlet 44 and out the second fluid outlet 49, a direction of a flow of the first fluid and the second fluid can oppose one another in the convaporator heat exchanger 55.

With further reference to FIG. 2, in some embodiments, a high pressure fluid can travel through the first corrugated heat exchanger element 42, the pressure of which can be higher than a fluid traveling through the second and third heat exchanger elements 41-1, 41-2. In an example, the enclosure 47 can provide structural support to the first corrugated heat exchange element 42. For example, where the fluid traveling through the first corrugated heat exchanger element 42 is of a high pressure, the enclosure can help to contain the fluid and prevent the high pressure fluid from rupturing the first corrugated heat exchange element 42. In some embodiments, the fluid traveling through the first corrugated heat exchanger element 42 can be from the saturated steam conduit 16, as discussed in relation to FIG. 1.

Figure 4:
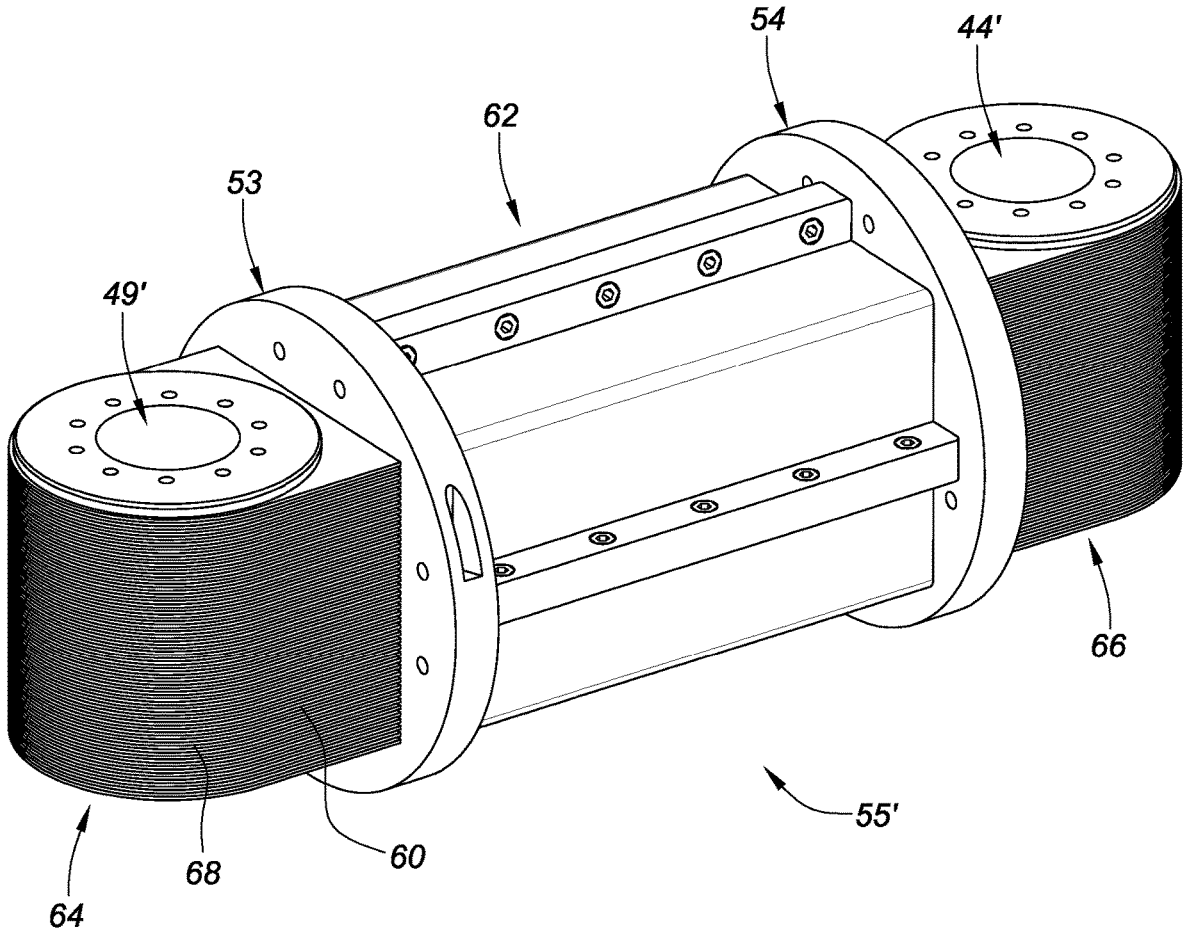
FIG. 4 depicts the convaporator heat exchange element of FIG. 3, in accordance with embodiments of the present disclosure.

FIG. 4 depicts the convaporator heat exchanger 55' of FIG. 3, in accordance with embodiments of the present disclosure. The corrugations of the heat exchange elements 41-1, 41-2, and 42 (FIG. 2) can all be bonded to their perspective adjoining surfaces. This aids in the high-performance heat transfer needed for this application. The bonding of heat exchange element 42 also improves the structural strength of the enclosure 47, while at the same time improving its heat transfer as opposed to a conventional heavier wall conduit in a standard heat exchanger design which would not produce the needed high levels of heat transfer per surface area. This improvement allows the passage of fluid between fins 60 that extend from either side of the convaporator heat exchanger 55'. In some embodiments, the convaporator heat exchanger 55' can include an exchanger body portion 62. The convaporator heat exchanger 55' can include an inlet fin portion 64 and an outlet fin portion 66, each of which can include a plurality of fins 60, which horizontally extend from opposing sides of the exchanger body portion 64 and are vertically spaced apart from one another to define fluid spaces 68 therebetween. As previously discussed, the convaporator heat exchange core 51 (FIG. 2) can be disposed inside of the exchanger body portion 62. The fluid spaces 68 can be fluidly coupled with the lumens 48 formed in the first corrugated heat exchange element 42 via a first flange 53 and a second flange 54.

In an example, the first flange 53 and the second flange 54 can be configured to route the fluid from the fluid spaces 68 into respective lumens 48 formed in the first corrugated heat exchange element 42. In some embodiments, depending on how the convaporator heat exchanger 55' is constructed, the first flange 53 and the second flange 54 can be configured to route the fluid from the fluid spaces 68 into respective lumens 46 formed in the second and third corrugated heat exchange elements 41-1,41-2. In some embodiments, a tube that defines the inlet 44' can extend vertically and perpendicular through the plurality of fins in fin portion 66 and can include a 90 degree elbow, such that the lumen defined by the tube is fluidly coupled with the flange 54. In some embodiments, a tube that defines the outlet 49' can extend vertically and perpendicular through the plurality of fins 60 in fin portion 64 and can include a 90 degree elbow, such that the lumen defined by the tube is fluidly coupled with the flange 53. Fluid can enter the inlet 44' and can travel through the lumens 48 formed in the first corrugated heat exchanger element 42 and out the outlet 49'. Embodiments of the present disclosure can allow for the passage of fluid through the fluid spaces and around a volume consumed by the tube that defines the inlets 44' and 49', without causing significant flow losses or pressure increases. In some embodiments, fluid can enter the exchanger body portion from all sides from the fluid inlet 43 via a plenum formed by flange 53. The flanges 53, 54 can be sealed around a perimeter of each flange 53, 54 and an inner wall of an outer housing 70 (FIG. 3), in some embodiments. For example, in some embodiments O-rings can be used to seal the flanges, however any sealing method can be used.

A high level of heat transfer per cubic volume can be obtained through the design of the convaporator heat exchange core 51, the convaporator housing 52, and the convaporator heat exchanger 55 depicted in FIGS. 2-4, which can be a critical attribute in making this thermodynamic cycle viable. In some embodiments, the convaporator heat exchange core 51 can include a level of heat transfer per cubic volume of up to 5,500 kilowatts per 0.11 meter cubed; however, embodiments are not so limited and the convaporator heat exchange core 51 can include a level of heat transfer per cubic volume above or below this level.

As shown in FIG. 1, the convaporator 19 can be fed via saturated steam conduit 16. Saturated steam can pass from the saturated steam conduit 16 into a condensing side 45 of the convaporator heat exchanger 19 and can be a high pressure condensing flow stream. Within the convaporator 19, the saturated steam (e.g., high pressure condensing flow stream), can release its heat to the evaporating side 40 of the convaporator, which can be operating at a lower pressure and thus lower saturated steam temperature than the condensing side 45. The mixture exiting the condensing side 45 via condenser side condensate conduit 20 can have the steam fraction of the mixture at least partially condensed. The partially condensed mixture can be passed through condenser side condensate conduit 20 to expansion device 21 where its pressure is reduced and directed out the expansion conduit 22. The expansion device 21 (e.g., throttling valve) can be located downstream of the condensing side 45 of the convaporator 19.

The condensed portion of the mixture flowing through the expansion conduit 22 can be collected in a low pressure separation tank 23 and directed back to the evaporator side 40 of the convaporator 19 via separation tank condensate conduit 24, return pump 29, and evaporator side condensate conduit 27. To reclaim energy and improve the thermodynamics of the cycle, the gaseous flow of steam and CO2, which has been separated from the condensed portion of the mixture via the low pressure separation tank 23, can continue through separation tank exhaust conduit 25 to low pressure condensing-separator tank 11. In some embodiments, the feedwater conduit 10 can pass through the low pressure condensing-separator tank 11 and in particular through a heat exchanger disposed within the low pressure condensing-separator tank 11. The gaseous flow of steam and CO2 can transfer a portion of its heat energy to the feedwater flowing through feedwater conduit 10 (e.g., via a heat exchanger disposed within the condensing-separator tank 11, which can act as an economizer). The portion of the steam that condenses within the condensing-separator tank 11 can be withdrawn via condensing-separator condensate conduit 26. In some embodiments, the portion of the mixture that remains gaseous or suspended in gas within the condensing-separator tank 11, leaves through condensing-separator exhaust conduit 36.

Through inclusion of the expansion device 21 (e.g., pressure reducing device), a pressure in the conduits leading to the low pressure separation tank 23 and the low pressure condensing-separator tank 11 and the tanks themselves can be reduced. Thus, pressures within the low pressure separation tank 23 and the low pressure condensing-separator tank 11 can be reduced, allowing for low pressure tanks to be used instead of high pressure tanks, which can reduce cost and complexity, as well as alleviate additional safety concerns associated with high pressures.

An optional expansion device 35 can be fluidly coupled with the condensing-separator exhaust conduit 36. In some embodiments, the optional expansion device 35 can be a turbo expander coupled to a generator pump and/or compressor, which can extract work energy out of the fluid passing from the condensing-separator exhaust conduit 36 to net further thermodynamic efficiency.

Flow pumps 28, 29 can be used to control the relative flows and the levels in the low pressure condensing-separator tank 11 and low pressure separation tank 23 respectively. The outputs of the flow pumps 28, 29 can be combined and transported via the evaporator side condensate conduit 27. The fluid from the evaporator side condensate conduit 27 that has been separated from the CO2 in low pressure separation tank 23 and low pressure condensing-separator tank 11 can be passed through an evaporator side 40 of the convaporator 19. Within convaporator 19, the fluid that is fed from evaporator side condensate conduit 27 and passed through the evaporator side 40 can be heated by the fluid from saturated steam conduit 16 that is passed through the condensing side 45, to produce clean, largely CO2 free steam at evaporator side steam conduit 30, which can be directed into the injection well 31.

In some embodiments of the present disclosure, the processed steam can enter the hot side (e.g., condensing side 45) of the convaporator via saturated steam conduit 16. Processed steam can be condensed through the condenser side 45 of the convaporator 19. In some embodiments, an expansion device 21 (e.g., throttling valve) can be adjusted to control (e.g., reduce) the pressure of the processed steam and/or condensate traveling from the condenser side condensate conduit 20 through expansion conduit 22 and separation tank exhaust conduit 25, thus controlling the pressure in the low pressure separation tank 23 and the low pressure condensing-separator tank 11, which affects the partial pressure and thus mass and volume ratios of the gaseous steam and CO2. In some embodiments, the pressure of the processed steam and/or condensate traveling through the condenser side condensate conduit 20 can be approximately 8 mega pascals (MPa) and the pressure of processed steam and/or condensate traveling through the expansion conduit 22 can be reduced by the expansion device to approximately 5 MPa, although pressures in the condensate conduit 20 and/or the expansion conduit 22 can be greater than or lower than those discussed herein. In some embodiments, the expansion device 21 can reduce the pressure between the condensate conduit 20 and the expansion conduit 22 by up to 70 percent.

These conditions are only one of an infinite number of combinations possible. Those skilled in the art will recognize the process will operate correctly if the condition of the processed steam entering the convaporator 19 via saturated steam conduit 16 is higher in energy and temperature than steam exiting at the evaporator side steam conduit 30 of the convaporator 19 and the convaporator 19 is effective enough in heat transfer to allow at least some phase change to occur on both the condensing and evaporating sides of the convaporator 19.

In some embodiments, the convaporator 19 can consist of several separate units while being the thermodynamic equivalent of the convaporator 19, as shown. This is done for purposes of both packaging and recognizing the change in properties such as density that occur as the fluid is evaporated and condensed.

In some embodiments, the output of the DSG 13 is such that the steam from saturated steam conduit 16 is superheated. Accordingly, under appropriate conditions the superheated saturated steam in saturated steam conduit 16 can produce super-heated steam in evaporator side steam conduit 30. In some embodiments, a separate optional superheater 32, can be included to produce super-heated steam where it has benefits above saturated steam in injection well 31 or other applications including power generation. For example, in some embodiments, the super-heater 32 can be in fluid communication with the evaporator side steam conduit 30.

In optional expansion device 35 (e.g., post controlled expansion unit), expanded exhaust constituents can be fed via an exhaust conduit 37 to an Air Pollution Control Process 38, before being exhausted via treated exhaust outlet 39. The CO2 could also be extracted at separation tank exhaust conduit 25, exhaust conduit 37, treated exhaust outlet 39, and/or at condensing-separator exhaust conduit 36 to facilitate high and/or lower pressure CO2 and exhaust injection or use. This method of steam and CO2 generation can be used in a positive way in many industries other than the oil recovery industry. Those skilled in the art will recognize the benefits of the processes described in the present disclosure when applied to the power generation industry.

Embodiments are described herein of various apparatuses, systems, and/or methods. Numerous specific details are set forth to provide a thorough understanding of the overall structure, function, manufacture, and use of the embodiments as described in the specification and illustrated in the accompanying drawings. It will be understood by those skilled in the art, however, that the embodiments may be practiced without such specific details. In other instances, well-known operations, components, and elements have not been described in detail so as not to obscure the embodiments described in the specification. Those of ordinary skill in the art will understand that the embodiments described and illustrated herein are non-limiting examples, and thus it can be appreciated that the specific structural and functional details disclosed herein may be representative and do not necessarily limit the endoscope of the embodiments, the endoscope of which is defined solely by the appended claims.

Reference throughout the specification to "various embodiments," "some embodiments," "one embodiment," or "an embodiment", or the like, means that a particular feature, structure, or characteristic described in connection with the embodiment(s) is included in at least one embodiment. Thus, appearances of the phrases "in various embodiments," "in some embodiments," "in one embodiment," or "in an embodiment," or the like, in places throughout the specification, are not necessarily all referring to the same embodiment. Furthermore, the particular features, structures, or characteristics may be combined in any suitable manner in one or more embodiments. Thus, the particular features, structures, or characteristics illustrated or described in connection with one embodiment may be combined, in whole or in part, with the features, structures, or characteristics of one or more other embodiments without limitation given that such combination is not illogical or non-functional.

Although at least one embodiment for improved dirty water and exhaust constituent free, direct steam generation, convaporator system, apparatus and method has been described above with a certain degree of particularity, those skilled in the art could make numerous alterations to the disclosed embodiments without departing from the spirit or scope of this disclosure. All directional references (e.g., upper, lower, upward, downward, left, right, leftward, rightward, top, bottom, above, below, vertical, horizontal, clockwise, and counterclockwise) are only used for identification purposes to aid the reader's understanding of the present disclosure, and do not create limitations, particularly as to the position, orientation, or use of the devices. Joinder references (e.g., affixed, attached, coupled, connected, and the like) are to be construed broadly and can include intermediate members between a connection of elements and relative movement between elements. As such, joinder references do not necessarily infer that two elements are directly connected and in fixed relationship to each other. It is intended that all matter contained in the above description or shown in the accompanying drawings shall be interpreted as illustrative only and not limiting. Changes in detail or structure can be made without departing from the spirit of the disclosure as defined in the appended claims.

Any patent, publication, or other disclosure material, in whole or in part, that is said to be incorporated by reference herein is incorporated herein only to the extent that the incorporated materials does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

The invention claimed is:

1. A system for generating steam, comprising:

a direct steam generator configured to generate saturated steam and combustion exhaust constituents from feedwater;

a close coupled heat exchanger fluidly coupled to the direct steam generator, the close coupled heat exchanger configured to route the saturated steam and combustion exhaust constituents through a condenser portion of the close coupled heat exchanger via a condenser side steam conduit and configured to condense the saturated steam to form a condensate, wherein the condenser portion of the close coupled heat exchanger includes a first corrugated heat exchange element, surrounded by an enclosure;

a pressure reducing device fluidly coupled with a condenser side condensate conduit of the condenser portion of the close coupled heat exchanger;

a separation tank and water return system fluidly coupled to the pressure reducing device via an expansion conduit, wherein the separation tank and water return system is configured to separate the combustion exhaust constituents from the condensate; and an evaporator portion of the close coupled heat exchanger fluidly coupled with the separation tank and water return system via an evaporator side condensate conduit, wherein the evaporator portion is configured to evaporate the condensate from the separation tank and water return system via heat transfer between the condenser portion and evaporator portion of the close coupled heat exchanger to form super-heated steam, wherein the evaporator portion of the close coupled heat exchanger includes a second corrugated heat exchange element disposed on the enclosure on an opposite side of the enclosure from the first corrugated heat exchange element.

2. A system for generating steam, comprising:

a direct steam generator;

a feed conduit fluidly coupled to the direct steam generator configured for delivery of feedwater to the direct steam generator, wherein the feedwater includes organic and inorganic constituents;

a fuel source fluidly coupled to the direct steam generator to provide power to operate the direct steam generator;

at least one of an air conduit and an oxygen enriched air conduit fluidly coupled with the direct steam generator;

a close coupled heat exchanger fluidly coupled to the direct steam generator, the close coupled heat exchanger configured to route saturated steam and combustion exhaust constituents produced by the direct steam generator through a condenser portion of the close coupled heat exchanger via a condenser side steam conduit and configured to condense the saturated steam to form a condensate, wherein the condenser portion of the close coupled heat exchanger includes a first corrugated heat exchange element, surrounded by an enclosure;

a pressure reducing device disposed after the condenser portion of the close coupled heat exchanger and fluidly coupled to the condenser portion of the close coupled heat exchanger via a condenser side condensate conduit;

a separation tank and water return system fluidly coupled to the pressure reducing device via an expansion conduit, wherein the separation tank and water return system is configured to separate the combustion exhaust constituents from the condensate; and an evaporator portion of the close coupled heat exchanger fluidly coupled with the separation tank and water return system via an evaporator side condensate conduit, wherein the evaporator portion is configured to evaporate the condensate from the separation tank and water return system via heat transfer between the condenser portion and evaporator portion to form super-heated steam, wherein the evaporator portion of the close coupled heat exchanger includes a second corrugated heat exchange element disposed on the enclosure on an opposite side of the enclosure from the first corrugated heat exchange element.

3. A system for generating steam, comprising:

a direct steam generator configured to generate saturated steam and combustion exhaust constituents from feedwater;

a close coupled heat exchanger fluidly coupled to the direct steam generator, the close coupled heat exchanger configured to route the saturated steam and combustion exhaust constituents through a condenser portion of the close coupled heat exchanger via a condenser side steam conduit and configured to condense the saturated steam to form a condensate, wherein the condenser portion of the close coupled heat exchanger includes a first corrugated heat exchange element, surrounded by an enclosure;

a pressure reducing device located downstream of the condenser portion of the close coupled heat exchanger and fluidly coupled with a condenser side condensate conduit of the close coupled heat exchanger;

a separation tank and water return system fluidly coupled to the pressure reducing device via an expansion conduit, wherein the separation tank and water return system is configured to separate the combustion exhaust constituents from the condensate;

an evaporator portion of the close coupled heat exchanger fluidly coupled with the separation tank and water return system via an evaporator side condensate conduit, wherein the evaporator portion is configured to evaporate the condensate from the separation tank and water return system via heat transfer between the condenser portion and evaporator portion of the close coupled heat exchanger to form super-heated steam wherein the evaporator portion of the close coupled heat exchanger includes a second corrugated heat exchange element disposed on the enclosure on an opposite side of the enclosure from the first corrugated heat exchange element.

4. The system of claim 1, wherein the system further comprises a turbo expander fluidly coupled to the separation tank and water return system, wherein the turbo expander is configured to reclaim energy from the combustion exhaust constituents.

5. The system of claim 4, wherein the turbo expander is configured to generate electricity, power a pump, or power a compressor, from the combustion exhaust constituents.

6. The system of claim 1, wherein the feedwater includes produced water.

7. The system of claim 1, wherein the feedwater includes produced water and dirty makeup water.

8. The system of claim 1, wherein the feedwater includes produced water, dirty makeup water, and bitumen process pond water.

9. The system of claim 1, further comprising a superheater in fluid communication with the evaporator portion of the close coupled heat exchanger via an evaporator steam conduit, wherein the superheater is configured to further heat the steam formed by the evaporator portion to improve the quality of the steam.

10. The system of claim 1, wherein oxygen enriched air is used for combustion in the direct steam generator and includes a percentage of oxygen by volume in a range from 25% to 100% and wherein the separated combustion exhaust constituents includes a percentage of CO2 by volume in a range from 20% to 100%.

11. The system of claim 10, wherein the CO2 from the separated combustion exhaust constituents is injected into a SAGD well.

12. The system of claim 10, wherein the CO2 from the separated combustion exhaust constituents is injected into a storage location.

13. The system of claim 1, wherein an additional heat exchanger is fluidly coupled with the condenser condensate conduit and the separation tank and water return system.

14. The system of claim 1, wherein an additional heat exchanger or economizer is fluidly coupled with the separation tank to aid in reclaiming energy.

15. The system of claim 1, wherein an additional heat exchanger or economizer is fluidly coupled with the separation tank to aid in reclaiming energy by transferring heat energy from the combustion exhaust constituents to the direct steam generator feedwater.

16. The system of claim 1, wherein a heat exchanger is fluidly coupled between the evaporator side condensate conduit and the separation tank and water return system.

17. The system of claim 1, wherein a super-heater is fluidly coupled between the evaporator portion of the close coupled heat exchanger and an injection well pipe.

* * * * *